US007104752B2

(12) United States Patent
Matheny et al.

(10) Patent No.: US 7,104,752 B2
(45) Date of Patent: Sep. 12, 2006

(54) BRAIDED WIRE DAMPER FOR SEGMENTED STATOR/ROTOR AND METHOD

(75) Inventors: Alfred Paul Matheny, Jupiter, FL (US); Kenneth I. Nelson, Stuart, FL (US)

(73) Assignee: Florida Turbine Technologies, Inc., Stuart, FL (US)

( * ) Notice: Subject to any disclaimer, the term of this patent is extended or adjusted under 35 U.S.C. 154(b) by 159 days.

(21) Appl. No.: 10/975,224

(22) Filed: Oct. 28, 2004

(65) Prior Publication Data

US 2006/0093471 A1 May 4, 2006

(51) Int. Cl.
*F04D 29/66* (2006.01)

(52) U.S. Cl. ..... 415/119; 416/194; 416/190; 416/500

(58) Field of Classification Search ..... 415/119; 416/500, 194, 195, 196 R, 190; 267/136, 267/148

See application file for complete search history.

(56) References Cited

U.S. PATENT DOCUMENTS 791,744 A * 6/1905 Arnold ..... 416/196 R
4,268,223 A * 5/1981 Anner et al. ..... 416/196 R
5,690,322 A * 11/1997 Hay ..... 267/148

* cited by examiner

*Primary Examiner*—Edward K. Look
*Assistant Examiner*—Dwayne J White
(74) *Attorney, Agent, or Firm*—Norman Friedland

(57) ABSTRACT

The segments of the vanes of a stator and the blades of a rotor for a gas turbine engine are dampened by utilizing braided wire cable that is affixed to adjacent segments such that each of the wire strands forming the cable is allowed to move relative to each other to dissipate the vibratory energy inflicted on the stator or rotor. The ends of the cable are welded or heated and then tapered to facilitate fitting into a sleeve or collar which in turn is affixed to the adjacent segments by braze, weld or the like.

18 Claims, 2 Drawing Sheets

BRAIDED WIRE DAMPER FOR SEGMENTED STATOR/ROTOR AND METHOD

CROSS-REFERENCE TO RELATED APPLICATION

None

STATEMENT REGARDING FEDERALLY SPONSORED RESEARCH OR DEVELOPMENT

None

TECHNICAL FIELD

This invention relates to the stator and the rotor for gas turbine engines and more particularly to the stator and the rotor of the type that are segmented and the means for damping the same.

BACKGROUND OF THE INVENTION

As is well known in the gas turbine technology, the stators for the compressors, the compressor rotors, the stator for the turbine rotors and the turbine rotors are all subjected to extreme vibrations when the engine is operated and particularly when in gas turbine engines powering aircraft. It is also well known that there has been and continues to be a great emphasis of solving the vibration problems that are associated with gas turbine engines. While dampers are frequently employed to dissipate the vibratory energy, these damper take on many different configurations, sizes and shapes of many different materials. This patent application addresses the vibration problems of the stator and the rotor of gas turbine engines when these devices are fabricated as segments, either in segments consisting of single vanes or blades or segments consisting of multiple vanes or blades.

It is also well known that commercially available braided wire has heretofore been utilized to dampen vibrations in devices utilized for securing pipes, tubes, rods and the like mounted on gas turbine engine cases. For example, U.S. Pat. No. 5,950,970 granted to myself and McGhee on Sep. 14, 1999 entitled CABLE CLAMP DAMPER teaches the use of braided wire to clamp pipes to the casing of an aircraft gas turbine engine and the damping is a result of the individual strands of the braided wire rubbing against each other to dissipate the energy of the vibrations. It is noted that in these teachings the problem being addressed is the attachment of the tubes or pipes or the like to a case that is subjected to extreme vibrations. This invention begins where those teachings leave off. The problem being solved by this invention is dissipating the energy of the vibrations that are induced in a stationary stator or a rotary rotor where the hardware is made in segments. In other words, the braided wire of this invention is not utilized to hold the segments in place inasmuch as there are other means that perform this function. But rather, the concept of this invention addresses the problem of solving the problem associated with the extreme vibratory motion of the individual segments of a segmented vane or a segmented blade configuration of the stator or rotor of a gas turbine engine.

SUMMARY OF THE INVENTION

An object of this invention is to provide for a turbine of a gas turbine engine improved dampen means for the segmented stator and the segmented rotor.

A feature of this invention is to provide a braided wire cable attached to at least one adjacent segments comprising the segmented stator or rotor.

Another feature of this invention is to provide a tubular member for receiving the end of the braided wire and attaching the tubular member to the adjacent stator segment or rotor segment.

Another object of this invention is the method of welding the ends of the braided wire to prevent the rotation of individual strands and to cut the end of the weld into a taper configuration to fit into a tube, collar or sleeve intended to secure the braided wire to the stator segment or rotor segment.

The foregoing and other features of the present invention will become more apparent from the following description and accompanying drawings.

These figures merely serve to further clarify and illustrate the present invention and are not intended to limit the scope thereof.

DETAILED DESCRIPTION OF THE INVENTION

While the invention is describing a stator vane assembly as being illustrative of the preferred embodiment, it is to be understood that the invention is equally applicable to segmented bladed rotors and that the segments may include a single blade or a single stator vane, the segments can include multiple stator vanes or multiple blades.

Figure 1:
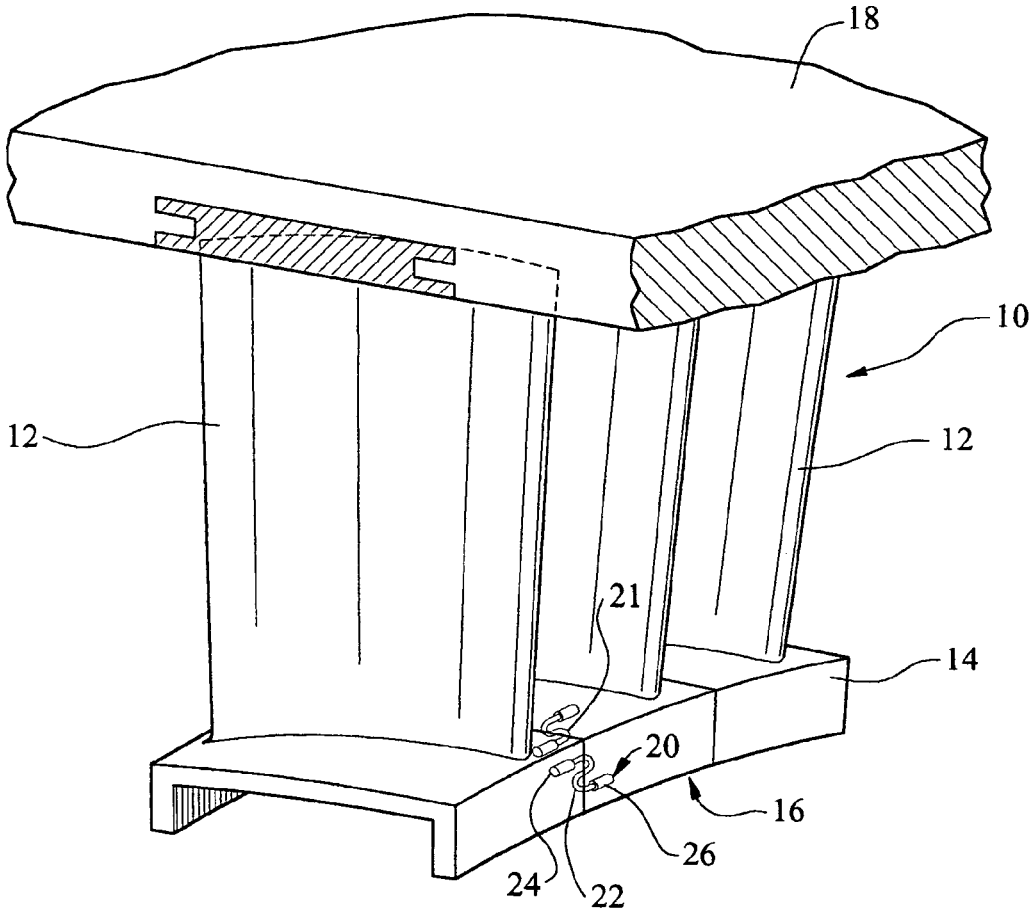
FIG. 1 is a fragmentary perspective view of a segmented stator incorporating the present invention.

Reference will now be made to FIG. 1 which is a perspective view of a partial stator of stator vanes generally indicated by reference numeral 10 comprising the circumferentially spaced vanes 12 each of which include a platform 14 at the lower extremity defining the segmented inner shroud 16 and being attached to an outer shroud 18 at vane 12 outer extremity. Stator vane construction is well known and for more details of their construction reference should be made to U.S. Pat. No. 4,741,667 granted to Price et al on May 3, 1988 entitled STATOR VANE; U.S. Pat. No. 5,022,818 granted to Scalzo on Jun. 11, 1991 entitled COMPRESSOR DIAPHRAGM ASSEMBLY, and U.S. Pat. No. 5,365,663 granted to Demartini on Nov. 22, 1994 entitled METHOD OF ATTACHING A MONITOR TARGET TO A SHROUDED BLADE all of which patents are incorporated herein by reference. When applying the inventive damper to a segmented rotor, the damper is attached to adjacent platforms of each adjacent segment of the rotor.

Figure 2:
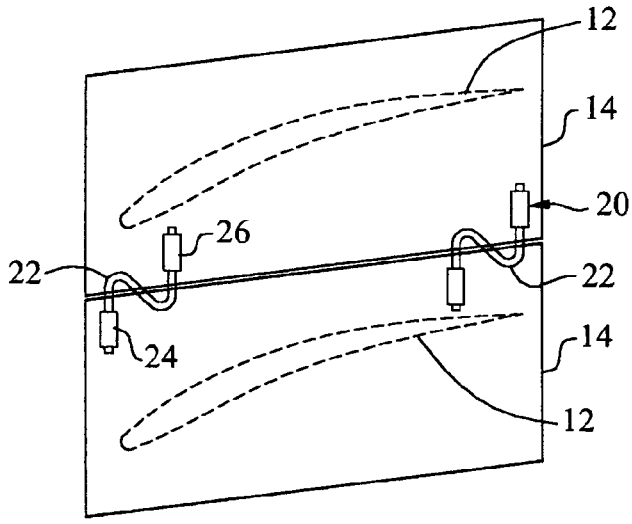
FIG. 2 is a plan view of the embodiment depicted in FIG. 1 illustrating a pair of adjacent stator segments illustrating the present invention.

In accordance with this invention the braided wire cable damper generally illustrated by reference numeral 20 is attached to adjacent segments 14. Each end of the braided wire cable 22 fits into a tube defining the collar or sleeve 24 and 26 and is frictionally fitted therein so that each of the strands of the braided wire is sufficiently loose so as to move relative to each other, but tight enough in the sleeve 24 so as not to become dislodged. This assures that the strands when imparted with vibratory movement will rub against each other and dissipate the vibratory energy to perform the dampening function. Sleeve 24 and sleeve 26 are respectively suitably secured to a surface of the platform 14. The method of securing can take any well known technique such as welding, brazing or the like and the location of the mount will be predicated on the particular design of the stator or rotor. In the example presented in FIGS. 1 and 2, the damper 20 is mounted on the front face of the platform 14 in adjacent segments, the upper face of the platform in adjacent segments and the lower face of the platform in adjacent segments. Of course, these drawings merely show examples of locations of the damper and do not necessarily represent the location when applied to actual hardware.

Figure 3:
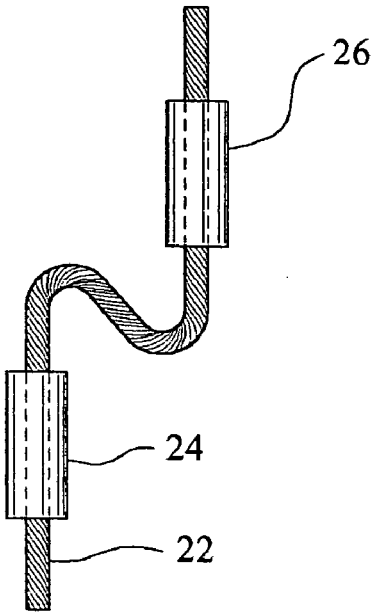
FIG. 3 is a view in elevation illustrating one embodiment of the present invention.
Figure 5:
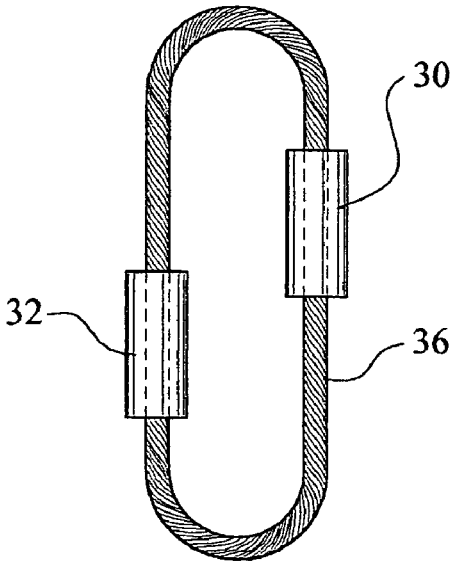
FIG. 5 is a view in elevation illustrating another embodiment of the present invention.

FIG. 3 is illustrative of one of the wire cables 22 with the collars or sleeves 24, mounted thereon. Typically, the sleeves slide over the wire cable and when properly located are either crimped to hold them in place yet allowing sufficient movement of the individual strands of the wire cable to move and slide so as to dissipate the heat generated by the movement of the these cable. Obviously, the vibrations are generated by the movement of the blades when in the operative mode. In this embodiment the wire cable is configured into an "S" shape. FIG. 5 is exemplifies another embodiment of this invention where the braided wire is configured into a race track or oval shape. Again the sleeves 30 and 32 are mounted on the wire cable 36 and each of the sleeves are affixed to adjacent blades, preferably on the platform of the blades.

Figure 4:
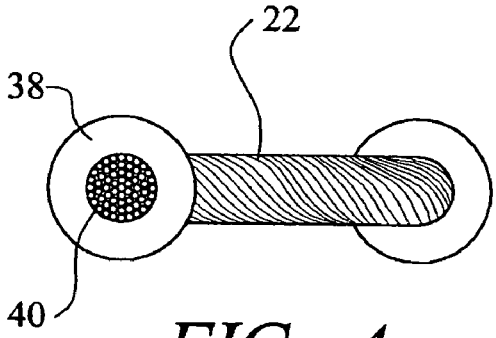
FIG. 4 is a perspective view of a prior art braided wire cable.
Figure 6A:
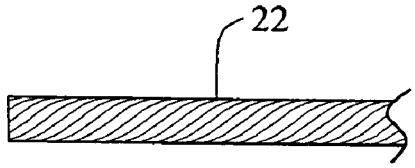
FIG. 6A is a partial view in elevation illustrating a prior art braided wire cable prior to being prepared for insertion in a retaining tube.
Figure 6B:
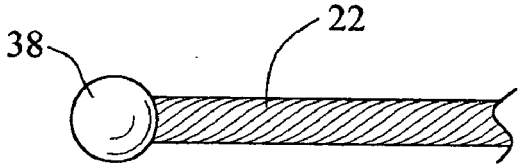
FIG. 6B is a partial view in elevation of the embodiment depicted in FIG. 6A after being prepared to secure the individual strands in the braided wire cable.
Figure 6C:
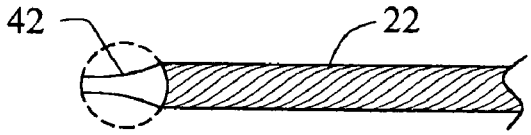
FIG. 6C is a view in elevation and phantom illustrating the result of the braided wire cable during one of the steps in the method of assembling the damper to the segmented structure.

FIGS. 4 and 6A–6C illustrate the method of securing the individual strands of the wire cable and finishing the tips thereof to facilitate the assembly into the sleeves. As shown in FIG. 4, the end is heated or welded and a cut of the bulbous end 38 shows the strands 40 of the wire cable. FIG. 6 illustrates the wire before the end is heated or welded. FIG. 6 B illustrates the wire cable after the end is heated or welded. And FIG. 6*c* illustrates the end after the bulbous end 38 is machined into a tapered tip 42.

Although this invention has been shown and described with respect to detailed embodiments thereof, it will be appreciated and understood by those skilled in the art that various changes in form and detail thereof may be made skilled in the art that various changes in form and detail thereof may be made without departing from the spirit and scope of the claimed invention.

The invention claimed is:

1. A stator for a gas turbine engine comprising a plurality of segments defining a ring, a plurality of circumferentially spaced vanes in each of said plurality of segments being subjected to vibratory motion, the improvement comprising:

a braided wire cable having a proximal end and a distal end;

a pair of collars each of which are adapted to surround and fit said braided wire at said proximal end and said distal end and allowing each wire of said braided wire to move relative to each other in response to the vibratory motion;

each of said pair of collars being affixed to adjacent segments of said plurality of segments;

whereby the movement of individual wires in said braided wire dissipates the energy of said vibratory motion.

2. A stator for a gas turbine engine as claimed in claim 1 including a shroud portion of said each segment of said plurality of segments and said shroud portion being adjacent to one end of each of said vanes of said plurality of circumferentially spaced vanes;

each of said collars of said pair of collars being affixed to adjacent shroud portions of said plurality of segments.

3. A stator for a gas turbine engine as claimed in claim 2 wherein said braided wire cable configured in an "S" shape between said pair of collars.

4. A stator for a gas turbine engine as claimed in claim 2 wherein the braided wire is configured in an oval shape.

5. A stator for a gas turbine engine as claimed in claim 1 wherein said proximal end and said distal end is welded and tapered to define a pointed portion.

6. A rotor for a gas turbine engine comprising a plurality of segments defining a ring, a plurality of circumferentially spaced blades in each of said plurality of segments being subjected to vibratory motion, the improvement comprising:

a braided wire cable having a proximal end and a distal end;

a pair of collars each of which are adapted to surround and fit said braided wire at said proximal end and said distal end and allowing each wire of said braided wire to move relative to each other in response to the vibratory motion;

each of said pair of collars being affixed to adjacent segments of said plurality of segments;

whereby the movement of individual wires in said braided wire dissipates the energy of said vibratory motion.

7. A rotor for a gas turbine engine as claimed in claim 6 including a platform on each segment of said plurality of segments and said platform portion being adjacent the root end of each of said blades;

each of said collars of said pair of collars being affixed to adjacent platforms of said plurality of segments.

8. A rotor for a gas turbine engine as claimed in claim 7 wherein said braided wire cable configured in an S shape between said pair of collars.

9. A rotor for a gas turbine engine as claimed in claim 7 wherein the braided wire is configured in an oval shape.

10. A rotor for a gas turbine engine as claimed in claim 6 wherein said proximal end and said distal end are welded and tapered to define a pointed portion.

11. The method of making a damper for the segmented stator of a gas turbine engine to dissipate the energy produced by the vibratory motion created when the gas turbine engine is in operation, comprising the steps of:

I) providing a braided wire;

ii) providing a pair of collars;

iii) fitting the collars to either end of the braided wire and securing the wire therein with sufficient force to allow movement of individual wires; and iv) affixing the collars to the adjacent segments.

12. The method as claimed in claim 11 including the steps of v) welding the wire prior to step iii) to form a bulbous end; and vi) machining the bulbous end to form a tapered portion on each end of the braided wire.

13. The method as claimed in claim 12 including the step of configuring the braided wire to an "S" shape prior to the step in step iii).

14. The method as claimed in claim 12 including the step of configuring the braided wire to an oval shape prior to the step in step iii).

15. The method of making a damper for the blades and platform of a segmented rotor of a gas turbine engine to dissipate the energy produced by the vibratory motion created when the gas turbine engine when in operation, comprising the steps of:

I) providing a braided wire;

ii) providing a pair of collars;

iii) fitting the collars to either end of the braided wire and securing the wire therein with sufficient force to allow movement of individual wires; and iv) affixing the collars to the adjacent platforms of the segmented rotor.

16. The method as claimed in claim 15 including the steps of v) welding the wire prior to step iii) to form a bulbous end; and vi) machining the bulbous end to form a tapered portion on each end of the braided wire.

17. The method as claimed in claim 16 including the step of configuring the braided wire to an "S" shape prior to the step in step iii).

18. The method as claimed in claim 17 including the step of configuring the braided wire to an oval shape prior to the step in step iii).

* * * * *